US006186315B1

(12) United States Patent
Schmick

(10) Patent No.: US 6,186,315 B1
(45) Date of Patent: Feb. 13, 2001

(54) APPARATUS FOR TRANSPORTING A STREAM OF PARTICULATE MATERIAL

(75) Inventor: Clemens Schmick, Geesthacht (DE)

(73) Assignee: Hauni Maschinenbau AG, Hamburg (DE)

( * ) Notice: Under 35 U.S.C. 154(b), the term of this patent shall be extended for 0 days.

(21) Appl. No.: 09/127,758

(22) Filed: Jul. 31, 1998

(30) Foreign Application Priority Data

Aug. 2, 1997 (DE) ..... 197 33 443

(51) Int. Cl.[7] ..... B65G 13/02

(52) U.S. Cl. ..... 198/689.1; 131/894; 131/280; 198/847

(58) Field of Search ..... 131/84, 84.3, 84.1, 131/280; 198/689.1, 847

(56) References Cited

U.S. PATENT DOCUMENTS

| | | | | |
|---|---|---|---|---|
| 3,164,158 | | 1/1965 | Labbe | 131/84 |
| 3,613,692 | * | 10/1971 | Gomann | 131/280 |
| 3,736,941 | * | 6/1973 | Molins et al. | 131/84.3 |
| 3,810,475 | * | 5/1974 | Labbe | 131/84.3 |
| 3,851,652 | * | 12/1974 | Labbe | 131/84.3 |
| 4,207,907 | * | 6/1980 | Dyett | 131/84.3 |
| 4,305,409 | * | 12/1981 | Dyett et al. | 131/84.3 |
| 4,344,526 | | 8/1982 | Quarella | 198/687 |
| 4,620,552 | * | 11/1986 | Hinzmann | 131/84.3 |
| 4,805,641 | | 2/1989 | Radzio et al. | 131/280 |
| 5,072,742 | | 12/1991 | Heitmann | 131/84.3 |
| 5,119,938 | * | 6/1992 | Beckh et al. | 198/847 |
| 5,370,136 | * | 12/1994 | Dawson et al. | 131/84.1 |
| 5,622,189 | * | 4/1997 | Dawson et al. | 131/84.1 |
| 5,626,152 | * | 5/1997 | Davis et al. | 131/84.1 |
| 5,743,275 | * | 4/1998 | Dawson et al. | 131/84.1 |

FOREIGN PATENT DOCUMENTS

| | | |
|---|---|---|
| 2449224 | 4/1976 | (DE) . |
| 4215059A1 | 11/1993 | (DE) . |
| 629853 | 9/1949 | (GB) . |
| 973210 | 10/1964 | (GB) . |
| 974821 | 11/1964 | (GB) . |

* cited by examiner

*Primary Examiner*—Christopher P. Ellis
*Assistant Examiner*—Richard Ridley
(74) *Attorney, Agent, or Firm*—Venable; George H. Spencer; Robert Kinberg

(57) ABSTRACT

The perforated bottom wall of a suction chamber in the tobacco stream gathering and transporting apparatus of a cigarette rod making machine is designed to guide and support a file of discrete apertured inserts which have undersides serving as abutments for the lower reach of an endless foraminous tobacco stream gathering and advancing belt. Portions of the inserts can be inserted into or removed from one or more grooves provided in the bottom wall and extending longitudinally of a channel which is open from below and has a top wall constituted by the lower reach of the belt as well as by the file of inserts. At least a portion of each insert can be made of a strongly wear-resistant material. An advantage of the inserts is that they render it possible to select the rates of air flow through different portions of the lower stretch of the belt, that they can be made to stand pronounced wear in a high-speed rod making machine, and that replacement of one or a few relatively small inserts often suffices to restore the integrity of a damaged transporting apparatus.

16 Claims, 2 Drawing Sheets

APPARATUS FOR TRANSPORTING A STREAM OF PARTICULATE MATERIAL

CROSS-REFERENCE TO RELATED APPLICATION

This application claims the priority of German Application No. 197 33 443. 1, the subject matter of which is incorporated herein by reference.

BACKGROUND OF THE INVENTION

The invention relates to improvements in apparatus for transporting streams or analogous accumulations of particulate materials. More particularly, the invention relates to improvements in apparatus which can be utilized with advantage for the transport of streams of comminuted tobacco leaves (such as cut ribs and/or shredded tobacco leaf laminae) in so-called rod making machines.

A modern cigarette rod making machine comprises an upwardly extending duct serving to deliver an ascending shower of comminuted tobacco leaves, reconstituted tobacco and/or artificial tobacco into an elongated channel having a foraminous top wall constituted by the lower reach or stretch of a driven endless belt or band. The upper side of the lower stretch advances along the underside of a stationary suction chamber so that the underside of such lower stretch can attract tobacco particles which form a growing stream advancing first past a suitable surplus removing trimming or equalizing device and thereupon into a wrapping mechanism to be draped into a continuous web of cigarette paper or other suitable wrapping material. The thus obtained continuous cigarette rod is severed to yield a file of plain cigarettes of unit length or multiple unit length which are ready to be transported to storage, to a packing machine or to a so-called filter tipping machine serving to assemble plain cigarettes with suitable filter mouthpieces for tobacco smoke.

Transporting apparatus of the above outlined character are also known as suction belt or band conveyors. The suction chamber is relatively long because the lower stretch of the endless foraminous belt must advance tobacco particles through an elongated stream building zone, thereupon past the trimming device, and thereafter all the way to the running web of cigarette paper or another strip or web of wrapping material in the aforementioned wrapping mechanism. The lower stretch of the rapidly advancing belt (a modern cigarette rod making machine is designed to turn out well in excess of 10,000 cigarettes per minute) is subject to pronounced wear as a result of frictional rubbing contact with the adjacent stationary parts of the apparatus; and this also holds true for the guide (such as the perforated bottom wall of the suction chamber) which compels the lower stretch of the belt to advance along a predetermined path past the stream building and trimming stations and all the way to the wrapping station.

Apparatus of the above outlined character are disclosed, for example, in U.S. Pat. Nos. 4,344,526 and 4,805,641 as well as in British Patent No. 974,821. The disclosures of all patents referred to in this specification are incorporated herein by reference.

OBJECTS OF THE INVENTION

An object of the invention is to provide a novel and improved apparatus for transporting streams or flows of continuously advancing particulate materials, for example, particulate materials of the tobacco processing industry in cigarette rod making machines or the like.

Another object of the invention is to reduce wear upon the belt- or band-contacting parts of such apparatus.

A further object of the invention is to provide a novel and improved bottom wall for the suction chamber in the tobacco transporting apparatus of a cigarette rod making machine.

An additional object of the invention. is to provide a transporting apparatus wherein damage to a certain constituent or component part of a constituent does not necessitate replacement of the entire constituent.

Still another object of the invention is to provide a novel and improved rod making machine, e.g., a cigarette, cigar or cigarillo making machine.

A further object of the invention is to provide an apparatus of the above outlined character wherein the endless particle gathering and advancing belt or band can stand much longer periods of continuous or intermittent use than the belts or bands in presently known apparatus.

Another object of the invention is to provide an apparatus which can be rapidly converted to any one of a plurality of different modes of operation, for example, to change the intensity of suction at different regions of the particle gathering and transporting stretch or reach of the foraminous belt or band.

An additional object of the invention is to provide a novel and improved stream gathering channel or trough for use in the above outlined rod making apparatus.

Still another object of the invention is to provide a novel and improved method of rapidly repairing or restoring a suction-operated transporting apparatus for particles of tobacco leaves and/or other particulate materials in a cigarette rod making or analogous machine.

A further object of the invention is to provide a novel and improved method of selecting and/or varying the intensity of suction at one side of an endless foraminous belt or band for the gathering and/or transport of streams of tobacco particles or the like.

An additional object of the invention is to provide novel and improved constituents of cigarette rod making machines which can be put to use in existing machines as superior (such as longer-lasting and more versatile) substitutes for heretofore utilized constituents.

SUMMARY OF THE INVENTION

The invention is embodied in an apparatus which can be utilized with advantage to transport a stream of particulate material, especially cut and/or shredded tobacco leaves and/or other particulate materials of the tobacco processing industry. More particularly, the invention is embodied in an apparatus wherein an elongated stretch of a stream advancing band (particularly an endless belt or band) having first and second sides is confined in a predetermined portion (normally in the deepmost portion) of an elongated channel. The improvement resides in the provision of an elongated guide which can constitute the top wall of the channel and is adjacent the aforementioned predetermined portion of such channel, and of an elongated support including at least one file of discrete neighboring inserts provided in the guide. The at least one file of inserts extends longitudinally of the channel, and its discrete inserts are arranged to be contacted by one side of the stretch.

The elongated guide is preferably provided with at least one recess or groove which extends longitudinally of the channel and movably receives portions of the inserts. The inserts are or can be slidable relative to the guide longitudinally of the at least one groove.

The apparatus can further comprise means for releasably securing one or more inserts to the guide and/or to another stationary part of the apparatus. For example, such securing means can comprise one or more threaded fasteners in the form of elongated pins, studs, bolts or the like.

The elongated stretch has two elongated marginal portions (such marginal portions can constitute the selvages of a woven band), and the inserts can be provided with surfaces which are adjacent the one side and at least one marginal portion of the stretch. The one side can constitute (and normally constitutes) the upper side of the stretch, and the surfaces of each insert then include a bottom surface which is adjacent the upper side of the stretch.

The apparatus normally further comprises two elongated sidewalls which flank the channel. A first surface of each insert in such apparatus is adjacent the one side of the stretch, and a second surface of the insert faces away from the respective first surface. The channel is or can be open at the second surfaces of the inserts to permit introduction of particulate material, preferably from below.

In accordance with one presently preferred embodiment, the inserts have at least substantially plane surfaces adjacent the one side of the elongated stretch of the band.

Alternatively, each insert can have a first surface (e.g., an essentially plane surface) which is adjacent the one side of the stretch, and concave surfaces adjacent the marginal portions of the stretch.

In accordance with a third presently preferred embodiment, each insert has a concave surface (such as a part cylindrical surface) which is adjacent the one side as well as the marginal portions of the stretch.

The stretch can be and preferably is foraminous. The guide and the inserts are then provided with openings which permit the flow of air through the foraminous stretch. The sequence of inserts in the at least one file is preferably variable which is particularly advantageous if the guide has and/or the inserts have openings of different sizes and/or shapes. This renders it possible to select the rate of air flow through various portions of the stretch by the simple expedient of altering the sequence of some or all of the inserts in the at least one file. The means for inducing a flow of air (or another gaseous fluid) through the foraminous stretch can include a suction chamber at the other side of the stretch.

At least those portions of the inserts which are adjacent their stretch contacting surfaces can be made of or can contain one or more wear-resistant materials, e.g., highly wear-resistant metallic and/or ceramic materials.

The novel features which are considered as characteristic of the invention are set forth in particular in the appended claims. The improved transporting apparatus itself, however, both as to its construction and the modes of assembling and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
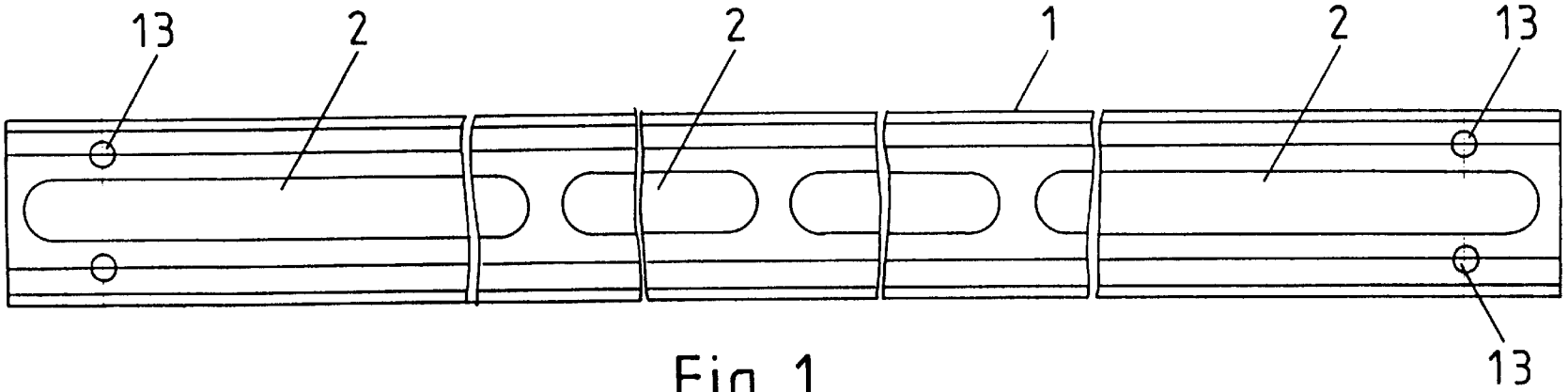
FIG. 1 is a fragmentary bottom plan view of an elongated apertured combined guide and support for a file or row of discrete inserts in a transporting apparatus embodying one form of the invention.
Figure 2:
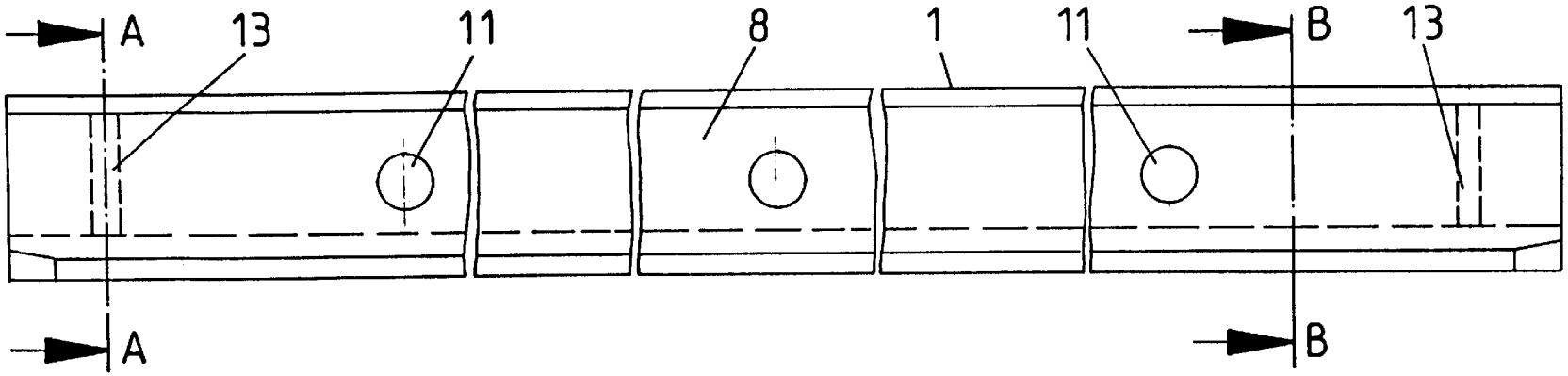
FIG. 2 is a fragmentary side elevational view of the guide which is shown in FIG. 1.

FIGS. 1 and 2 show, drawn to a larger scale, portions of an elongated guide 1 for the lower reach or stretch 6 of an endless foraminous belt or band forming part of a suction belt conveyor. The guide 1 has elongated openings 2 in the form of longitudinally extending slots which serve to admit air into a suction chamber 3 (see FIGS. 3 and 4). This guide can be said to form part of the bottom wall of the suction chamber 3 and part of the top wall for an elongated channel 7 (see again FIGS. 3 and 4). The channel 7 is flanked by two elongated sidewalls 14, 16 which are disposed at a level beneath the lower stretch 6 of the endless foraminous belt. This lower stretch is located in the topmost (i.e., deepmost) portion of the channel 7 (which is open at its lower end), and the underside of the lower stretch 6 serves to intercept and to thereupon attract and advance a growing stream of tobacco particles (not shown) when such particles are caused to rise in a suitable duct. Reference may be had, for example, to U.S. Pat. No. 5,072,742 which describes and shows a duct serving to deliver an ascending shower of tobacco particles against the underside of the lower stretch of an endless foraminous belt. The upper side of the lower stretch of the endless belt in the patented apparatus is adjacent an elongated suction chamber which attracts the tobacco particles to the underside of the lower stretch. The fully grown tobacco stream contains a surplus of tobacco particles, and such surplus is removed by a suitable trimming or equalizing device. The remaining tobacco particles form a trimmed stream (also called filler) which is transported by suction toward and is delivered into the range of a wrapping mechanism wherein the trimmed stream is draped into a continuous web or strip of cigarette paper or the like.

Figure 3:
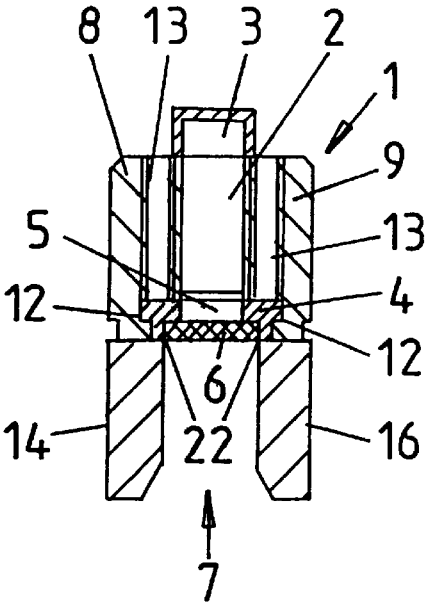
FIG. 3 is a transverse vertical sectional view of the guide, substantially as seen in the direction of arrows from the line A—A of FIG. 2, and further showing certain other parts of the improved transporting apparatus.
Figure 4:
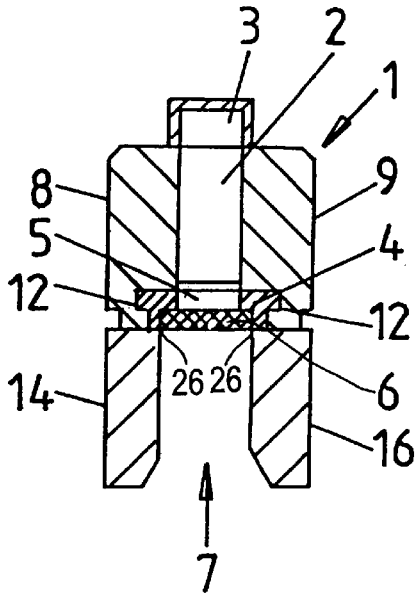
FIG. 4 is a similar transverse vertical sectional view of the guide, substantially as seen in the direction of arrows from the line B—B in FIG. 2, and further shows certain additional parts of the transporting apparatus.

Each of FIGS. 3 and 4 further shows one of an entire file or row of relatively short discrete inserts 4 (assumed to be of the type shown in FIG. 5) which have marginal portions received in and movable longitudinally of elongated grooves 12 at the undersides of two upwardly and longitudinally extending cheeks 8, 9 of the guide 1. These cheeks flank the suction chamber 3 and may but need not be rigidly affixed to the sidewalls 14, 16 flanking the channel 7 beneath the lower stretch 6.

FIG. 3 shows that the cheeks 8, 9 are provided with tapped bores 13 for elongated fasteners serving as a means for releasably securing at least some of the inserts (e.g., the foremost and the last insert of the file) to the guide 1. For example, the fasteners in the bores 13 can constitute locking screws. The cheeks 8, 9 are secured to each other by transversely extending fastening elements (e.g., bolts and nuts, not shown) having portions extending through preferably tapped aligned bores or holes 11 (see FIG. 2) in the cheeks.

The aforementioned grooves 12 are provided in or at the cheeks 8 and 9; such grooves confine the inserts 4 to movements at right angles to the plane of FIG. 3 or 4. The inserts 4 have openings 5 which can register with the adjacent openings 2 of the guide 1, either entirely or in part, depending upon the desired rate of air flow through the lower stretch 6 (the thickness of this lower stretch is exaggerated in FIGS. 3 and 4 for the sake of clarity), through the openings 5, 2 and into the suction chamber 3. The latter has at least one outlet connected to the suction side of a suitable fan, not shown. Thus, by the simple expedient of selecting the extent of overlap of the openings 5 with the openings 2, one can select the rate of air flow through selected portions of the lower stretch 6, i.e., the magnitude of the force with which the conveyor attracts tobacco particles to selected portions of the lower stretch 6. All that is necessary is to select the sequence in which the inserts 4 of two or more groups of inserts having differently dimensioned and/or positioned openings 5 are inserted into the grooves 12 of the cheeks 8, 9 of the guide 1. It is also possible to employ one or more inserts having no openings or more than a single opening. Analogously, all openings 2 in the guide 1 need not have the same size and/or shape.

Figure 5:
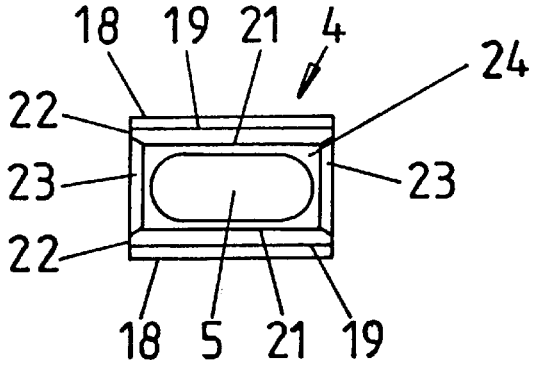
FIG. 5 is a plan view of an insert which can be assembled with and supported by a guide of the type shown in FIGS. 1 to 4.

The opening 5 of the insert 4 which is shown in FIG. 5 is an elongated slot which is located midway between the longitudinal ends of the insert.

The surfaces of the insert 4 of FIG. 5 include a centrally located longitudinally extending generally or exactly plane surface 24 which overlies the adjacent portion of the upper side of the lower stretch 6 of the endless belt. The narrow longitudinally extending marginal portions of the insert 4 of FIG. 5 (each such marginal portion is bounded by two surfaces 18, 19) are received in the grooves 12 of the respective cheeks 8, 9. The ridges 22 between the pairs of surfaces 19, 21 engage the marginal portions 26 of the lower stretch and guide the upper side of the lower stretch 6 along and in contact with the surface 24. The ends of the insert 4 are slightly chamfered, as at 23, to facilitate the introduction of the inserts between the cheeks 8, 9 and the respective sidewalls 14, 16. That side of the insert 4 which faces away from the observer of FIG. 5 is or can be flat.

The transporting apparatus including the structure shown in FIGS. 1 to 5 exhibits a number of important advantages. Thus, the inserts 4 are relatively short so that they can be readily introduced into the guide 1. Moreover, if a single insert 4 is damaged or clogged or otherwise affected, none of the remaining inserts need be discarded. Still further, the inserts can be made of a relatively expensive highly wear-resistant material (such as steel, another high-quality metal or alloy and/or a ceramic) because they can stand very long periods of intensive use (i.e., extensive frictional engagement with the running belt including the lower stretch 6). In addition, and as already mentioned above, the rate of inflow of air through selected portions of the lower stretch 6 can be varied as necessary by the simple expedient of using two or more sets or groups of inserts 4 having differently dimensioned, configurated and/or distributed openings 5.

Figure 6:
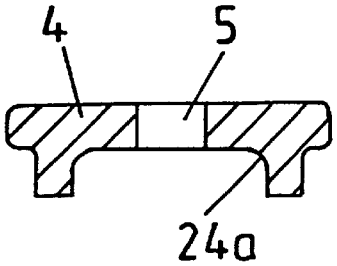
FIG. 6 is an enlarged transverse vertical sectional view of a modified insert.

FIG. 6 shows a portion of a slightly modified insert 4 having a narrower opening 5, a flat median bottom surface engageable by the adjacent portion of the upper side of the lower stretch 6 (not shown in FIG. 6), and two concave surfaces 24*a* which contact and guide the adjacent marginal portions of the lower stretch.

Figure 7:
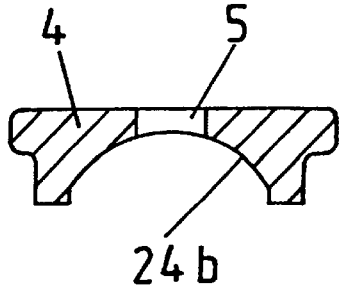
FIG. 7 is a similar enlarged transverse vertical sectional view of a further insert.

The insert 4 of FIG. 7 differs from the inserts of FIGS. 5 and 6 in that it comprises a part cylindrical concave surface 24*b* which contacts the upper side as well as the two marginal portions of the lower reach or stretch 6 (not shown in FIG. 7). Thus, the surface 24*b* can cause the adjacent portion of the lower stretch to assume a concavo-convex shape.

Even though they are preferably made of a highly wear-resistant material, certain inserts 4 are bound to undergo wear after extended periods of use in a high-speed rod making machine. However, replacement of one insert, or of a small number of inserts, is much less expensive than the replacement of a full-length bottom wall of the suction chamber, e.g., due to pronounced wear upon one or more relatively short portions of such bottom wall.

As a rule, or in many instances, the rate of air flow through the bottom stretch or reach 6 will be selected in such a way that it decreases in the direction of forward movement of the lower stretch, i.e., from the stream building station toward the trimming or equalizing station and/or from the equalizing station toward the wrapping station.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of apparatus for transporting particulate materials and, therefore, such adaptations should and are intended to be comprehended within the meaning and range of equivalence of the appended claims.

What is claimed is:

1. In an apparatus for transporting a stream of particulate material of the tobacco processing industry wherein an elongated foraminous stretch of a stream advancing band having a first side and a second side is confined to a lengthwise movement in a predetermined portion of an elongated channel, a combination comprising an elongated guide extending longitudinally of and adjacent said portion of said channel; and at least one file of discrete neighboring inserts provided in said guide with a variable sequence, said at least one file extending longitudinally of said channel and said discrete inserts being arranged to be contacted by one side of said stretch wherein said guide and said inserts have openings arranged to permit the flow of air through said foraminous stretch, and wherein said inserts include at least two groups and the inserts of each of said groups have openings of different sizes and/or shapes.

2. The structure of claim 1, wherein said predetermined portion is a deepmost portion of said channel.

3. The structure of claim 1, wherein said elongated guide has at least one groove extending longitudinally thereof and movably receiving portions of said inserts.

4. The structure of claim 3, wherein said inserts are slidable relative to said guide longitudinally of said at least one groove.

5. The structure of claim 1, further comprising means for releasably securing at least one of said inserts to said guide.

6. The structure of claim 5, wherein said securing means includes at least one threaded fastener.

7. The structure of claim 1, wherein said stretch has two elongated marginal portions and said inserts have surfaces adjacent said one side and at least one marginal portion of said stretch.

8. The structure of claim 7, wherein said one side is said upper side of said stretch and said surfaces of each of said inserts include bottom surfaces adjacent said upper side.

9. The structure of claim 1, further comprising two elongated sidewalls flanking said channel, each of said inserts having a first surface adjacent said one side of said stretch and a second surface facing away from said first surface, said channel being open at said second surfaces of said inserts.

10. The structure of claim 1, wherein said inserts have at least substantially plane surfaces adjacent said one side of said stretch.

11. The structure of claim 1, wherein said stretch has two elongated marginal portions and each of said inserts has a first surface adjacent said one side of said stretch and concave surfaces adjacent said marginal portions of said stretch.

12. The structure of claim 1, wherein said stretch has two elongated marginal portions and each of said inserts has a concave surface adjacent said one side and said marginal portions of said stretch.

13. The structure of claim 12, wherein said surfaces of said inserts are part cylindrical surfaces.

14. The structure of claim 1, further comprising means for inducing a flow of air through said foraminous stretch, said flow inducing means including a suction chamber at the other side of said stretch.

15. The structure of claim 1, wherein said inserts have stretch-contacting surfaces and include portions adjacent said surfaces, at least said portions of said inserts consisting of a wear-resistant material.

16. The structure of claim 1, wherein at least a portion of each of said inserts consists of a highly wear-resistant material selected from the group consisting of metallic and ceramic materials.

* * * * *